US005259469A

United States Patent [19]

Stjernström et al.

[11] Patent Number: 5,259,469

[45] Date of Patent: Nov. 9, 1993

[54] DRILLING TOOL FOR PERCUSSIVE AND ROTARY DRILLING

[75] Inventors: Karl-Axel Stjernström, Fagersta; Uno S. Löf, Sunne, both of Sweden

[73] Assignee: Uniroc Aktiebolag, Fagersta, Sweden

[21] Appl. No.: 910,078

[22] PCT Filed: Jan. 17, 1991

[86] PCT No.: PCT/SE91/00034

§ 371 Date: Oct. 7, 1992

§ 102(e) Date: Oct. 7, 1992

[87] PCT Pub. No.: WO91/10805

PCT Pub. Date: Jul. 25, 1991

[30] Foreign Application Priority Data

Jan. 17, 1990 [SE] Sweden ..... 9000156

[51] Int. Cl.[5] ..... E21B 10/32

[52] U.S. Cl. ..... 175/385; 175/292

[58] Field of Search ..... 175/382-389, 175/292, 398

[56] References Cited

U.S. PATENT DOCUMENTS

| | | | |
|---|---|---|---|
| 3,753,470 | 8/1973 | Lagerstrom et al. | 175/292 |
| 3,848,683 | 11/1974 | Persson | 175/65 |
| 4,440,244 | 4/1984 | Wiredal | 175/292 |
| 4,770,259 | 9/1988 | Jansson | 175/292 X |
| 5,009,271 | 4/1991 | Maric et al. | 175/385 X |
| 5,040,621 | 8/1991 | Lof | 175/385 X |

FOREIGN PATENT DOCUMENTS

| | | | |
|---|---|---|---|
| 0171915 | 2/1986 | European Pat. Off. | 10/60 |

*Primary Examiner*—Thuy M. Bui

*Attorney, Agent, or Firm*—Eric Y. Munson; Mark P. Stone

[57] ABSTRACT

A drilling tool for percussive and rotary drilling in advance of a trailing casing tube (20) has a reamer (15) pivotally journalled and an eccentric shaft (12) rearwardly of a centric pilot bit (11). The reamer (15) has an eccentric portion (32) carrying axially directed hard metal button inserts (36–40) grouped within an arcuate angle (V) of a circle sector centered on the drilling axis (C). The inserts comprise primary inserts (36–38) with a radial reach defining the full diameter of the drilled hole and inner secondary inserts (39, 40) closer to the shaft (12). The reamer (15) is pivotable on the shaft (12) between a projected and a retracted position. When projected, the group of button inserts (36–40) ream up the hole from the diameter drilled by the pilot bit (11) to the full diameter of the hole enabling the casing tube (20) to advance. In the retracted position, the drilling tool (10) can pass through the casing tube (20). A duality of inserts (36, 39) leading in the rotational direction act jointly to break rock in a direction substantially tangentially relative to the shaft (12).

12 Claims, 3 Drawing Sheets

DRILLING TOOL FOR PERCUSSIVE AND ROTARY DRILLING

The present invention relates to a drilling tool for percussive and rotary drilling in advance of a trailing casing tube, in which tool a pilot bit via an intermediate eccentric shaft is carried by a guide body, which is rotatably centered in and by the mouth of said casing tube on the rotational axis of said tool during drilling, and is coupled to drive means in said casing tube for actuation of said tool, a tubular reamer has an eccentric protruding portion carrying on one axial face thereof hard metal button inserts, and the reamer is pivotally mounted on said eccentric shaft between on the one hand a projected position, in which said eccentric portion with the button inserts thereon are adapted to ream up the hole from the initial diameter produced by said pilot bit to the full diameter of the hole enabling the casing tube to be advanced thereinto, and, on the other hand, a retracted position, in which the drilling tool can be passed through said casing tube.

The drive means usually comprise a drill string which within a string of interconnected casing tubes carries a downhole drill for direct actuation of the drilling tool by way of impacts and rotation as described for example in U.S. Pat. No. 3,848,683 (FIGS. 6-8) or, when tophammer drive is practiced, has the drill string directly coupled to the tool for actuation thereof. The latter drive is exemplified by U.S. Pat. No. 3,753,470 (FIGS. 1-3). In both drilling applications tools provided with hard metal button inserts of cemented tungsten carbide have been in extensive use for more than a decade. One such drilling tool is described in U.S. Pat. No. 4,440,244.

In drilling with tools of the above type normally the reamer element is subjected to the heaviest load and has a shorter operational life as compared to the other tool elements. It is generally expected that in the average two reamers will be worn out for each expended pilot bit, and two pilot bits for each guide body. It is therefore important that attempts to increase the operational life be directed primarily to the reamer so as to prolong the useful time cycle between servicing and change of worn tool elements.

It is an object of the invention to increase in drilling tools of the above type the life expectancy of the reamer primarily by improving the grouping and rock crushing action of its button inserts. Another object is to gain by the chosen rock breaking action that the produced rock debris tends to become more coarse in grain. Another object in connection therewith is to enable the produced coarser rock cuttings to be removed by more efficient flushing whereby secondary crushing of the debris by the inserts is reduced. A further object is to improve reamer work and flushing during drilling of tough clayey ground. These objects are attained by the features stated in the appended claims.

An embodiment of the invention and a modification thereof will be described hereinafter with reference to the appended drawings, wherein FIG. 1 shows, partly in section, the drilling tool in its drilling position in front of a casing tube to be driven down concurrently.

Figure 4:
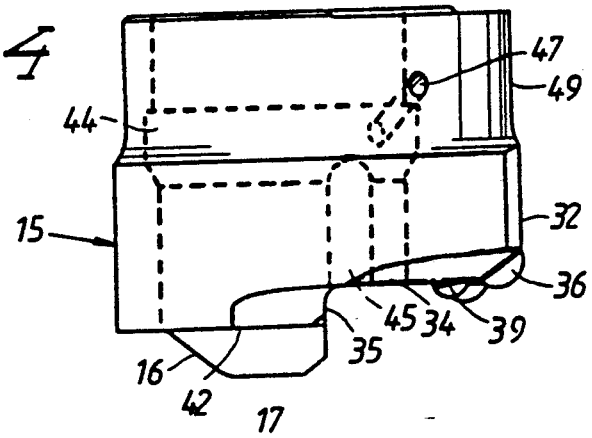
FIG. 4 shows a somewhat enlarged side view of the reamer in FIG. 3.
Figure 5:
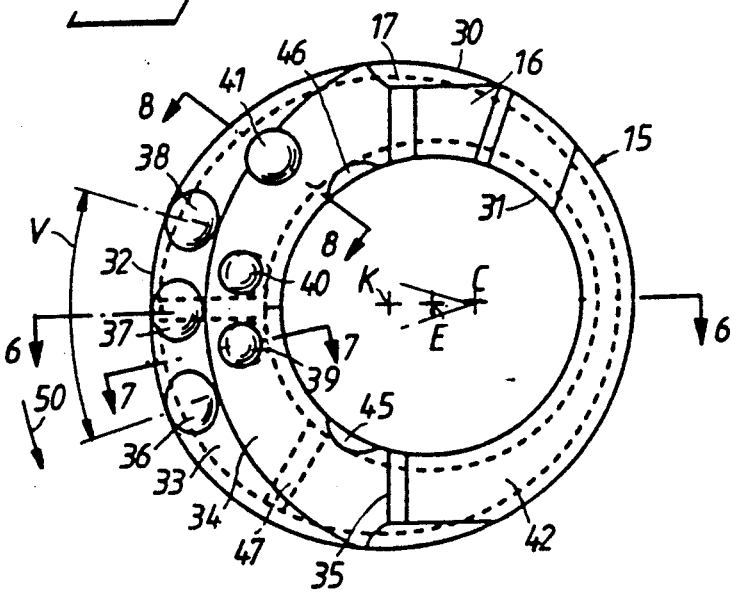
FIG. 5 shows on a still larger scale a view from below of the reamer in FIG. 1 seen on the line 5—5 thereof.
Figure 8:
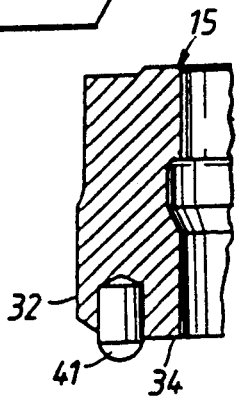
Figure 7:
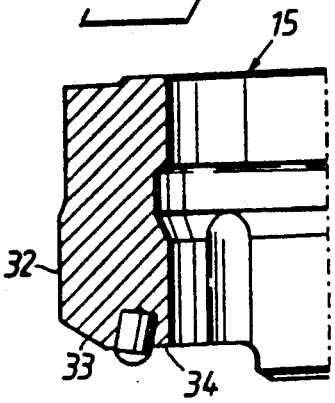
Figure 6:
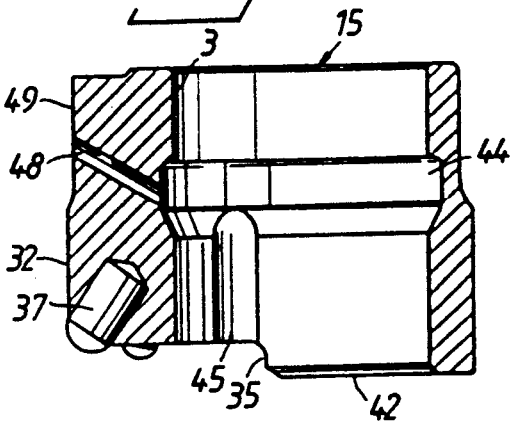

FIG. 6—8 are sections in the scale of FIG. 4 seen on the respective lines 6—6, 7—7, and 8—8 in FIG. 5.

Figure 3:
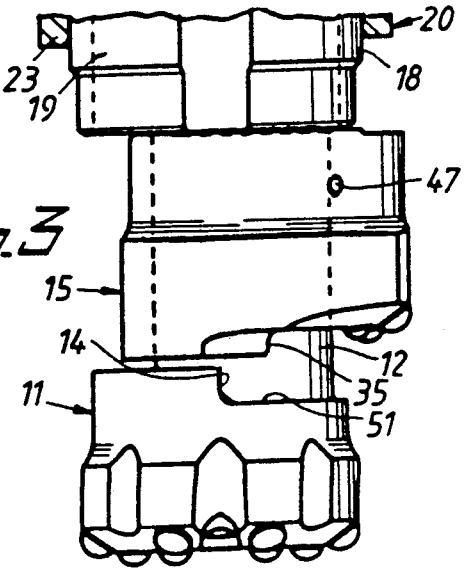
FIG. 3 shows the forward portion of the tool in FIG. 1 seen from the rear.
Figure 9:
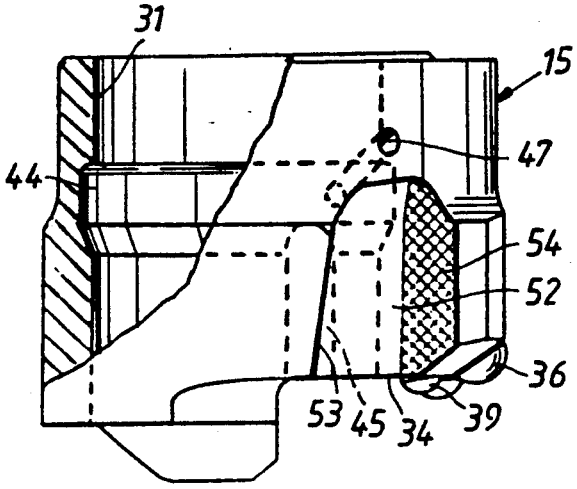

FIG. 9 shows enlarged a modified embodiment of the reamer depicted in a side view similar to FIG. 3.

Figure 10:
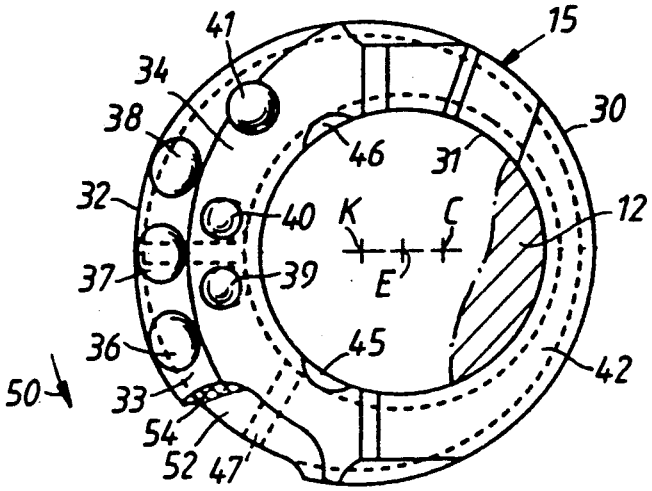

FIG. 10 is a view showing the modified reamer of FIG. 9 from below in a presentation similar to FIG. 5 but also indicating in section the eccentric shaft carrying the reamer.

Figure 1:
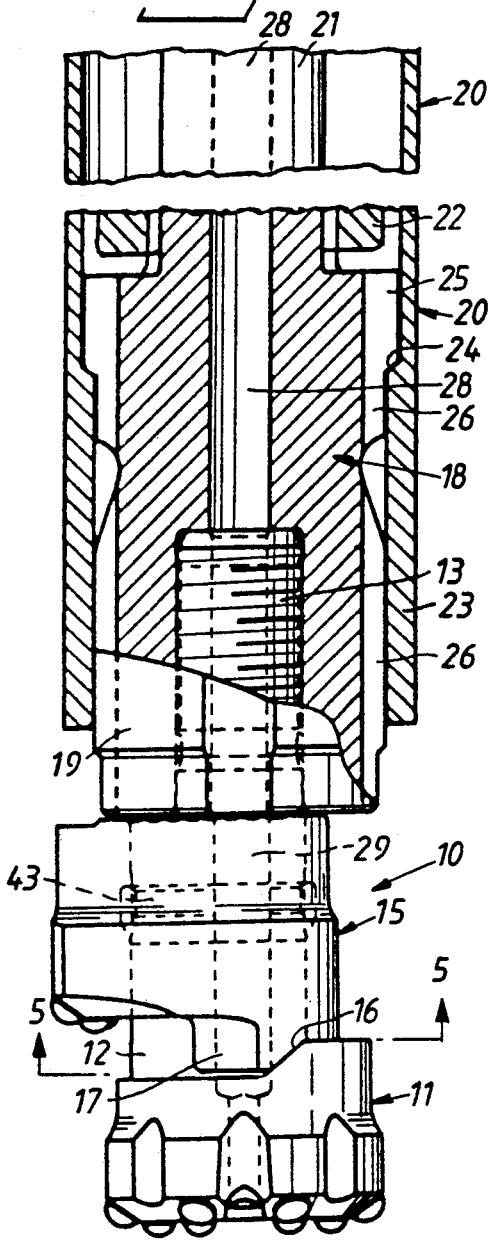

In analogy with the above cited patent references, the drilling tool in FIG. 1 comprises a pilot bit 11, a reamer 15 and a guide body 18. In practicing tophammer drilling the slightly modified guide body thus would be connected directly to a drill string. In the downhole drive example chosen in FIG. 1 the drill indicated at 22 is connected to be rotated within the casing tube 20 by the drill string 21 in unison with the guide body 18 while delivering impacts to the latter.

The cylindrical guide portion 19 of the guide body 18 is rotatably journalled in and centered by a casing shoe 23 forming the mouth of the casing tube 20 at the lower end thereof. The casing shoe 23 has a somewhat smaller inner diameter than the casing tube 20 and forms at the transition thereto an annular shoulder 24, against which a rear flange 25 on the guide body 18 abuts in order to transmit impact energy thereto so as to drive down the casing tube 20. Straight axial flushing grooves 26, for example three in number, are provided on the guide portion 19 and extend through the rear flange 25 for purposes of expelling flushing medium and drill cuttings from the hole to the interior of-the casing tube 20. At least one of the grooves 26 should during drilling be positioned to receive flushing medium from the broad spacing radially behind the reamer 15. Preferably the guide portion has an annular groove 27 formed centrally therearound for equalizing the flushing medium flow emitted through the axial grooves 26. Flushing medium is supplied via passages 28 in the drill string 21 and guide body 18 and is supplied to the hole via a central passage 29 in the pilot bit 11.

Figure 2:
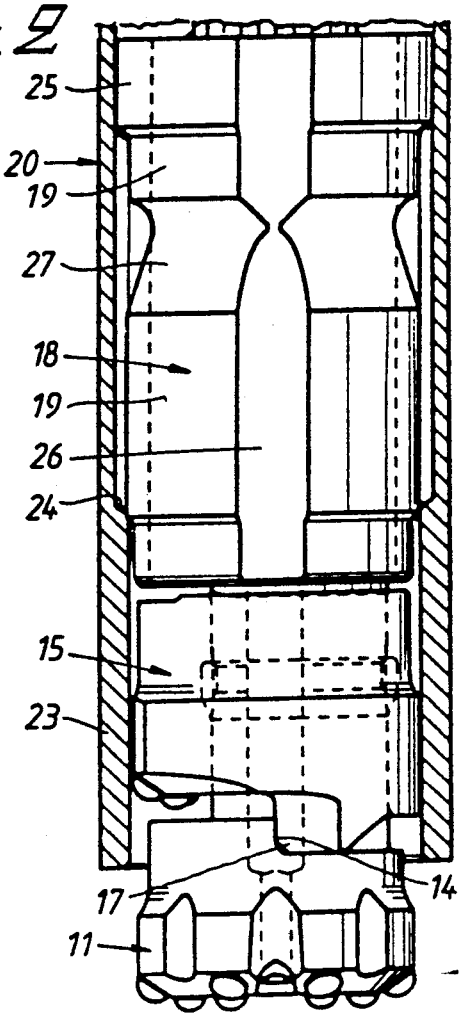
FIG. 2 shows the tool of FIG. 1 in retracted position while being passed through the casing tube.

The pilot bit 11 has an intermediate eccentric shaft 12 rearwardly prolonged by a threaded end 13 concentric with the pilot bit 11. The end 13 is received in centered threaded engagement with the guide body 18 and the intermediate eccentric shaft 12 carries pivotally the reamer 15 between a projected drilling position according to FIG. 1 and a retracted position shown in FIG. 2. The drilling position, in which the pilot bit 11 together with the reamer 15 are adapted to drill a hole larger than the outer diameter of the casing tube 20, is defined by an inclined abutment 16 at one end of a ledge 51 at the rear of the pilot bit 11. Abutment 16 transmits via a cooperating inclined lug 17 on the reamer 15 the joint rotation of the drill string 21, guide body 18 and pilot bit 11 on to the reamer 15 and urges the latter axially against the guide body 18 in order to eliminate play during transmission of impact energy therefrom. Upon turning of the drill string 21 180 degrees relative to the reamer 15, the straight rear portion of the reamer lug 17 moving along the ledge 51 is met by an axial abutment 14 thereat, FIG. 3, diametrically opposite to the inclined abutment 16. When brought together, the axial abutment 14 and the lug 17 define the retracted position, FIG. 2, in which the drilling tool 10 can be raised through and lowered down through the casing tube 20.

The reamer 15, FIG. 5, is a tubular substantially cylindrical steel body 30 centered on axis K and provided along a parallel axis E with an eccentric through bore 31 whereby the reamer 15 is pivotally journalled on the eccentric shaft 12 of the pilot bit 11. By the bore 31 the reamer body 30 becomes an eccentric symmetrically disposed with respect to a central plane through the axes K-E and having a radially protruding eccentric portion 32. That portion 32 has a circular crest centered on an axis C coplanar with plane K-E and being the rotational axis of the guide body 18 and the entire tool 10. The crest of the eccentric portion 32 is geometrically faced by an acute angle V of maximally about 36 degrees extending from the axis C and forming therewith a circle sector symmetrically divided by the plane K-E-C. At its crest the portion 32 is bevelled forming an inclined conical surface 33 with axis C as center. Surface 33 carries primary button inserts 36,37,38 of hard metal which are inclined outwardly relative to the drilling axis C and whose radial reach defines during drilling the full diameter of the hole. The primary button inserts, 37, FIG. 6, are preferably inclined 35 degrees relative to axis C and are grouped as close to one another as is permissible with respect to the necessary operational strength for the buttons, by experience at a distance between them of about 1.5 times their diameter. In hard rock it is preferred to have three primary buttons 36-38 on surface 33 as shown, while in softer ground the number can be reduced to two. The outer periphery of surface 33 outside angle V is rounded to conform with the mantle of reamer body 30 centered on axis E. The maximally possible value for angle V is limited by geometrical considerations depending on the size of the full diameter drilled, the necessary size of the shaft 12 for transmitting the impact energy required, and the demand that the primary inserts 36–38 on eccentric portion 32 upon retraction thereof should be retractable through the casing tube 20.

The reamer portion 32 has a plane axially directed front face 34 into which the bevelled surface 33 merges along a circular line centered on drilling axis C. Front face 34 extends from the lug 17 to a diametrically opposed abutment 35 on a axially protruding portion 42 by which the reamer 15 rests against the back of the pilot bit 11, and which extends peripherally back to the lug 17. The front face 34 carries secondary hard metal button inserts 39,40 placed on the same radius from axis C within the sector angle V and staggered radially inwardly of the primary button inserts 36–38. The arrangement for working hard rock will as shown be two secondary inserts 39,40 inwardly of three primary ones 36–38 or, for softer ground, one secondary inside two primary, in both cases in a symmetrical disposition relative to the middle plane K-E-C. To allow for closely concentrated grouping of the inserts the secondary inserts 39,40 have a somewhat smaller diameter than the primary ones 36–38 and their lasting attachment to the reamer 15 is assured by on the one hand inclining the secondary inserts somewhat less, for example only 10 degrees, than the primary ones 36–38 inclined at 35 degrees, and on the other hand by disposing the secondary inserts radially at a sufficient distance from the inner boundary of the bevelled surface 33.

The flushing passage 29 within the eccentric shaft 12 of the pilot bit 11 has a through crossbore 43 through which flushing medium is led to an inner supply groove 44 in the eccentric bore 31 of the reamer 15. Therefrom are branched two axially forwardly directed flushing grooves 45,46 extending to the front face 34 and opening towards respectively the abutment 35 and the lug 17. From the supply groove 44 there preferably extend two rearwardly directed oblique channels 47,48 to the diamwetrically somewhat reduced rear portion 49 of the reamer 15. One of them, 47, FIGS. 4, 5, emerges some distance behind the area of the front face 34 between the inserts 36,39 and the abutments 35,14. The other, 48, emerges also in rearwardly spaced relation at the plane of symmetry, FIG. 6. Through the channels 47,48 flushing medium is emitted to produce ejector action whereby flushing of the hard metal inserts 36–40 is enhanced.

During drilling the tool 10 rotates counterclockwise when viewed from the underside in FIG. 1 as indicated by the arrow 50 in FIG. 5. The pilot bit 11 drills, preferably likewise by the aid of hard metal button inserts, a pilot hole that is reamed up by the reamer button inserts 36–40 to a full diameter big enough to enable the casing tube 20 to be driven down concurrently while drilling is in progress. In the closely united group of reamer inserts 36-40 with all of them having their central axes within the limits of sector angle V, the secondary button inserts 39,40 are retracted and are trailing in the rotational direction 50 in a staggered way relative to the leading first primary insert 36 and its followers 37,38. Thereby the duality of leading button inserts 36,39 jointly attain a rock breaking action directed somewhat inwardly in the rotational direction, i.e. in substance tangentially relative to the shaft 12, and towards the abutments 14,35, FIGS. 3–5. This is the area swept by flushing medium (water,air,mist,or foam) from groove 45 and after reversal of the flow by the ledge 51 on the pilot bit 11 the debris loaded flushing medium flow escapes rearwardly through the broad clearance between the leading flank of the reamer 15 and the drilled full diameter hole. Simultaneously cleaning by flushing medium of the group of button inserts 36–40 is further enhanced by flushing medium emanating from the flushing groove 46, the ejector channels 47,48, and the debris laden retreating flushing medium flow from the perimeter of the pilot bit 11.

A separate trailing button insert 41, FIG. 5, 8, can be provided for working any residual rock fragments remaining in the radial spacing left between the primary 36–38 and secondary 39,40 inserts. The trailing insert 41 is disposed straightly axially, is set across the inner borderline of the bevelled surface, 33 and is spaced angularly for example 37.5 degrees relative to plane K-E-C and axis C.

For purposes of drilling for example a 115 mm hole it is recommended to choose diameter 14.5 mm for the primary button inserts, diameter 10.0 mm for the secondary, and 12.7 for the trailing insert.

In the embodiment of FIGS. 8, 9, a combined flushing and digging groove 52 is provided on the reamer flank that faces the rotational direction 50. The groove 52 extends shovellike towards the rear of the reamer 15, terminating on the reduced rear mantle portion 49 of the reamer body 30 some distance in front of flushing channel 47. The rotationally leading borderline 53 of the groove 52 in the example shown is somewhat inclined away from the rotational direction 50, while its opposed straight edge 54 is reinforced by hard metal, preferably by application of stellite. The flushing medium stream issuing from groove 45 is reversed by ledge 51, catches from the area in front of the duality of leading button inserts 36,39 the normally coarse rock debris broken out jointly by them, and expels the debris laden flushing medium through the reamer groove 52. The shovellike action of the groove 52 enhances the flow and so does its reinforced edge 54 by pushing and driving the cuttings in the rotational direction 50 for more easy removal. The concentrated flushing-away of debris from the area in front of the inserts 36,39 assures a reduced tendency towards secondary crushing of the cuttings, which due to the close adjacency of the foremost inserts 36,39 tend to become more coarsegrained than in conventional reaming. A flow enhancing action is also due to the rearwardly ejected flushing fluid stream issuing from the channel 47 upstream of the groove 52.

Experience shows that drilling in claybound ground becomes more easy due to the cutting action of the radially protruding trailing edge 54 of groove 52, whereby the inburst of tough clay is severed and flushed away portionwise. The tendency towards plugged flushing passages is thus reduced. In case of need the cutting edge 54 can be formed somewhat inclined, preferably helically with a steep pitch in the counterrotational direction to assure better clay removal.

We claim:

1. A drilling tool for percussive and rotary drilling in advance of a trailing casing tube (20), in which tool (10);

a) a pilot bit (11) via an intermediate eccentric shaft (12) is carried by a guide body (18), which is rotatably centered in and by the mouth (23) of said casing tube (20) on the rotational axis (C) of said tool (10) during drilling, and is coupled to drive means (21, 22) in said casing tube (20) for actuation of said tool (10), b) a tubular reamer has an eccentric protruding portion (32) carrying on one axial face thereof hard metal button inserts (36–40), and c) the reamer (15) is pivotally mounted on said eccentric shaft (12) between a projected position, in which said eccentric portion (32) with the button inserts, (36–40) thereon are adapted to ream up the hole from the initial diameter produced by said pilot bit (11) to the full diameter of the hole enabling the casing tube (20) to be advanced thereinto, and a retracted position, in which the drilling tool (10) can be passed through said casing tube (20), wherein said reamer (15) on its eccentric portion (32) comprises a duality of adjacent radially spaced button inserts (36, 39) leading in the rotational direction (50) during drilling of said tool (10) with the radially inner button insert (39) trailing in said direction immediately behind the outer button insert (36), said duality of button inserts (36, 39) being adapted jointly to break rock in a forward direction substantially tangentially relative to said shaft (12).

2. A drilling tool according to claim 1, wherein said button inserts (36–40) on said protruding portion (32) comprise radially outward primary button inserts (36,37,38) defining during drilling the full diameter of the hole, and secondary button inserts (39,40) disposed radially inwardly thereof, said primary and secondary button inserts (36-40) forming a closely united group with the button centers thereof falling within an acute angle (V) of a circle sector extending from said rotational axis (C) and defining the perimeter of said eccentric reamer portion (32).

3. A drilling tool according to claim 1, wherein said reamer (15) on the flank thereof that faces the rotational drilling direction (50) is provided with a groove (52) extending axially in rearward direction rotationally in front of said button inserts (36–40) and adapted to lead away flushing medium and drill cuttings expelled from said inserts (36–40).

4. A drilling tool according to claim 3, wherein said groove (52) forms an axial cutting edge (54) adjacent to and in front of said outer leading button insert (36).

5. A drilling tool according to claim 4, wherein said groove (52) is reinforced by hard metal material along said cutting edge (52).

6. A drilling tool according to claim 2, wherein said closely grouped primary and secondary button inserts (36–40) are outwardly inclined relative to said rotational axis (C), said secondary inserts (39,40) being less inclined and having a somewhat smaller diameter than said primary inserts (36–38).

7. A drilling tool according to claim 2, wherein a supply groove (44) for flushing medium is provided within said reamer (15), a forwardly directed flushing groove (45) extends from said supply groove (44) and opens towards the area rotationally in front of said duality of button inserts (36,39).

8. A drilling tool according to claim 3, wherein a supply groove (44) for flushing medium is provided within said reamer (15) and an inclined axially rearwardly directed flushing channel (47) extends from said supply groove (44) radially in outward direction to the rear of said groove (52) whereby flushing medium ejected through said channel (47) is adapted to enhance removal of flushing medium through said groove (52) by ejector action.

9. A drilling tool according to claim 6, wherein said primary an secondary button inserts (36–40) are disposed with their centers symmetrically grouped within said acute sector angle (V) and comprise three outer primary button inserts (36,37,38) with the intermediate one of them on the plane of symmetry of said sector and two inner peripherally staggered secondary button inserts (39,40) spaced from said plane.

10. A drilling tool according to claim 9, wherein said secondary button inserts (39,40) are spaced in radial direction inwardly of said primary button inserts (36–38) and a separate trailing button insert (41) on said reamer (15) outside said sector angle (V) is set to work any remaining rock in the radial spacing between said primary and secondary button inserts (36–40).

11. A drilling tool according to claim 2, wherein said reamer (15) on the flank thereof that faces the rotational drilling direction (50) is provided with a groove (52) extending axially in rearward direction rotationally in front of said button inserts (36–40) and adapted to lead away flushing medium and drill cuttings expelled from said inserts (36–40).

12. A drilling tool according to claim 3, wherein a supply groove (44) for flushing medium is provided with said reamer (15), a forwardly directed flushing groove (45) extends from said supply groove (44) and opens towards the area rotationally in front of said duality of button inserts (36, 39).

* * * * *